US008256404B2

(12) United States Patent
Tanaka et al.

(10) Patent No.: US 8,256,404 B2
(45) Date of Patent: Sep. 4, 2012

(54) OIL SEPARATOR FOR BLOW-BY GAS

(75) Inventors: Toshimitsu Tanaka, Toyota (JP); Jun Ikeda, Toyota (JP); Naoya Okada, Kasugai (JP)

(73) Assignees: Kojima Press Industry Co., Ltd., Aichi-ken (JP); Toyota Jidosha Kabushiki Kaisha, Aichi-ken (JP)

( * ) Notice: Subject to any disclaimer, the term of this patent is extended or adjusted under 35 U.S.C. 154(b) by 356 days.

(21) Appl. No.: 12/402,270

(22) Filed: Mar. 11, 2009

(65) Prior Publication Data

US 2009/0229585 A1 Sep. 17, 2009

(30) Foreign Application Priority Data

Mar. 13, 2008 (JP) ..... 2008-064023

(51) Int. Cl.
*F01M 13/04* (2006.01)
*B04C 5/04* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 6,279,556 | B1 | 8/2001 | Busen | |
| 6,684,864 | B1 * | 2/2004 | Busen et al. | 123/572 |
| 7,401,599 | B2 * | 7/2008 | Saito | 123/518 |
| 7,406,961 | B2 * | 8/2008 | Hilpert et al. | 123/572 |
| 2005/0188937 | A1 | 9/2005 | Hilpert | |

FOREIGN PATENT DOCUMENTS

| | | |
|---|---|---|
| JP | 2001246216 | 9/2001 |
| JP | 2002540338 | 11/2002 |
| JP | 2005233182 | 9/2005 |
| JP | 2006526731 | 11/2006 |

OTHER PUBLICATIONS

ChineseOffice Action dated Nov. 18, 2010 for Patent Application 200910126296.0 (7 pages).
English Translation of Chinese Office Action dated Nov. 18, 2010 for Patent Application 200910126296.0 (7 pages).
Japanese Office Action dated Feb. 2, 2010 for Patent Application 2008-064023 (2 pages).
English Translation of Japanese Office Action dated Feb. 2, 2010 for Patent Application 2008-064023 (2 pages).
English Abstract of JP Publication No. JP2005233182 (1 page).
English Translation for Abstract for JP2001246216 published Sep. 22, 2001 (2 p.).
English Translation of Abstract for JP2002540338 published Nov. 26, 2002 (1 p.).
English Translation of Abstract for JP2006526731 published Nov. 24, 2006 (1 p.).

* cited by examiner

*Primary Examiner* — Marguerite McMahon
(74) *Attorney, Agent, or Firm* — Conley Rose, P.C.

(57) ABSTRACT

To provide an oil separator including multiple cones and having a simple structure and high trapping efficiency for oil mist. An oil separator can include multiple cones arranged in a line and a chamber for blow-by gas, which is formed in adjacent to the line of the cones, and arranged at an upper side surface of the cones, the chamber being provided with a flow-in port at a position in front of the line of the cones, in which upper outer peripheral walls of the cones at portions facing the chamber constitute partition walls provided with slits, which constitute inlets for the blow-by gas to enter the cones.

18 Claims, 3 Drawing Sheets

OIL SEPARATOR FOR BLOW-BY GAS

This application claims priority to Japanese patent application serial number 2008-64023, the contents of which are incorporated herein by reference.

BACKGROUND OF THE INVENTION

1. Field of the Invention

The present invention relates to an oil separator for blow-by gas, and more particularly, to an oil separator for trapping oil mist in blow-by gas generated in an engine crankcase of an internal combustion engine such as an automobile engine, the oil separator being structured so that multiple cones trap the oil mist.

2. Description of the Related Art

In an internal combustion engine such as an automobile engine, at a time of operation thereof, blow-by gas leaks out from a gap between a piston ring and a cylinder wall. Further, emission of the blow-by gas into the atmosphere causes air pollution. Accordingly, by using a so-called positive crankcase ventilation (PCV) system provided inside the internal combustion engine, the blow-by gas is returned to an intake system and then reburnt.

In this case, the blow-by gas contains oil mist, which is atomized lubricating oil such as engine oil. Therefore, the oil mist in the blow-by gas needs to be prevented from flowing out to the intake system. In this regard, as means for trapping the oil mist in the blow-by gas, there is provided an oil separator midstream of a connection channel for connecting an intake pipe line with a crankcase or inside of a cylinder head cover.

In the previous described cone type oil separator configuration, a range of a flow rate of the blow-by gas, in which a cone can exert the best performance, is limited. Another known oil separator has proposed a single cone in the oil separator, yet a problem arises such that the flow rate of the blow-by gas is low, resulting in a deteriorated trapping performance for the oil mist.

Also proposed is a multiple cone configuration instead of the single cone configuration. In this configuration, cones are downsized so as to generate swirling flow even when the flow rate of the blow-by gas is low, whereby making it possible to efficiently trap the oil mist. When the flow rate of the blow-by gas is high, the trapping operation for the oil mist can be divided by the multiple cones.

Yet, since this configuration needs to have multiple cones, each of which is capable of efficiently separating the oil mist, the structure needs to be simple enough to keep manufacturing cost low.

In this case, in order to achieve efficient trapping of the oil mist by each cone, it has been considered to include a configuration in which a flow channel dedicated for the blow-by gas is provided to each of the cones so as to cause the blow-by gas to flow into each cone from a tangential direction. However, this method makes this configuration complicated, and leads to cost increase.

On the other hand, a structure in which the flow channel is partitioned at positions directly before the blow-by gas flows into each cone to introduce the flow of the blow-by gas in parts into each of the cones has been proposed. The blow-by gas hits against partitions of the flow channel, and hence a flow is likely to be disturbed. Further, the flowing-in blow-by gas needs to be distributed to the cones which are arranged in parallel and separated from each other, and hence the flow-in port for the blow-by gas into the cones are formed to have a wide width. As a result, the blow-by gas flows directly also into the vicinity of the cone centers. Therefore, the oil separator according to this configuration has a structure disadvantageous for forming the swirling flow in the cones, and an oil mist trapping efficiency of the cones is low or inefficient.

Therefore, there has been a need in the art for an oil separator having a multiple cone configuration, which has a simple structure and high trapping efficiency for oil mist.

SUMMARY OF THE INVENTION

To provide an oil separator including multiple cones and having a simple structure and high trapping efficiency for oil mist. An oil separator can include multiple cones arranged in a line and a chamber for blow-by gas, which is formed in adjacent to the line of the cones, and arranged at an upper side surface of the cones, the chamber being provided with a flow-in port at a position in front of the line of the cones, in which upper outer peripheral walls of the cones at portions facing the chamber constitute partition walls provided with slits, which constitute inlets for the blow-by gas to enter the cones.

DETAILED DESCRIPTION OF THE INVENTION

Each of the additional features and teachings disclosed above and below may be utilized separately or in conjunction with other features and teachings to provide an oil separator for blow-by gas. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
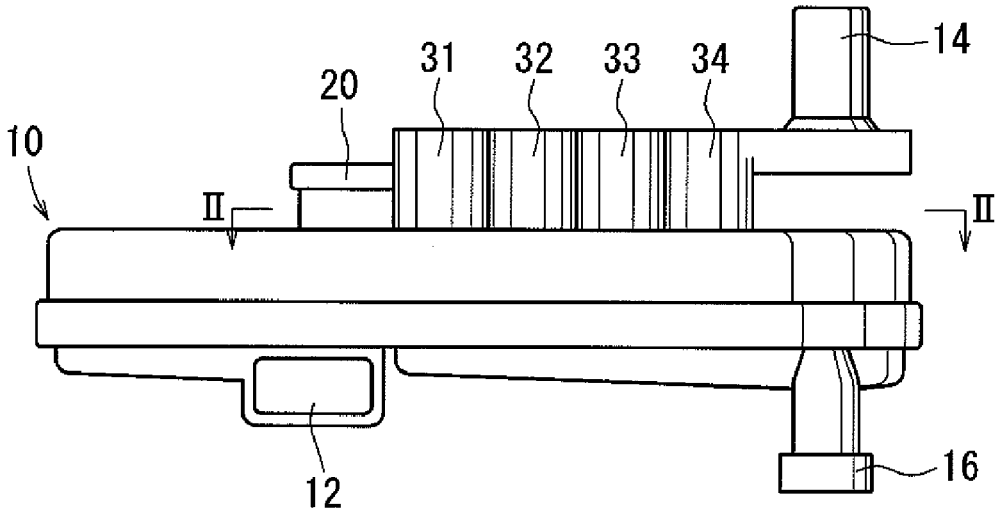
FIG. 1 is an external front view of an oil separator according to an embodiment of the present invention.

FIG. 1 is an external front view of an oil separator 10 arranged inside an automobile engine head cover. The oil separator 10 is a cone-type oil separator including four relatively small cones 31, 32, 33, and 34 arranged in a line. The term cone herein is broadly defined as cone-like in shape. As shown in the figures, the cone in these examples includes two substantially parallel side edges that extend substantially parallel with each other, then angle towards each other, thereby forming the cone. It should be recognized by those skilled in the function of the shape is to create a swirl-like flow or suction, and that the shapes herein are merely examples of achieving that function. Further, the oil separator 10 includes a rectification chamber 20 arranged on an upper side surface of the cones 31 through 34, a gas inlet 12 for introducing the blow-by gas therefrom, a gas exhaust port 14 for exhausting the blow-by gas therefrom, and an oil drain 16 for collecting oil separated from the blow-by gas.

The blow-by gas flowing in from the gas inlet 12 is introduced to the cones 31 through 34 via the rectification chamber 20. Then, a centrifugal force caused by a swirling flow generated inside the cones 31 through 34 agglutinates the oil mist in the blow-by gas, whereby the oil mist becomes oil and is separated from the blow-by gas. The separated oil adheres to outer peripheral walls of the cones 31 through 34 or drops under the cones, thereby being trapped to be collected from the oil drain 16. The blow-by gas from which the oil mist is separated and can be directed to and out of the gas exhaust port 14.

Figure 2:
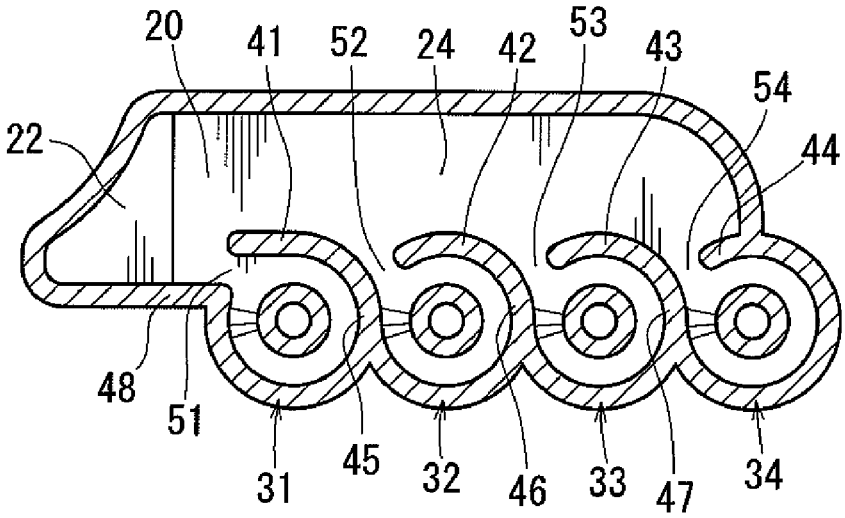
FIG. 2 is a sectional view taken along the line II-II of FIG. 1.

FIG. 2 is a sectional view taken along the line II-II of FIG. 1. As illustrated in FIG. 2, the-rectification chamber 20 includes a flow-in port 22 from which the blow-by gas introduced from the gas inlet 12 is directed to flow into the rectification chamber 20, the flow-in port 22 positioned in front of a line of cones 31 through 34. Further, in the upper position of the cones 31 through 34, in which the rectification chamber 20 is formed, the outer peripheral walls of the cones 31 through 34 at the portions facing the rectification chamber 20 constitute partition walls 41, 42, 43, and 44, which partially partition the rectification chamber 20 and the cones 31 through 34. Further, upper outer peripheral walls of the cones 31 through 34 have portions facing the adjacent cone constitute common walls 45, 46, and 47, and each is shared with an adjacent outer peripheral wall of the cone.

In the oil separator 10, the cones 31 through 34 and the rectification chamber 20 share wall surfaces with each other. Therefore, the oil separator is structured simply and has a more compact configuration. In addition, the cones are arranged in a line, and hence wide width is not required, whereby the oil separator can be arranged in a space having a narrow width. In this embodiment, the oil separator 10 is arranged inside the cylinder head cover, and hence the automobile engine can more compact.

In the cone 31 positioned nearest the flow-in port 22 for the blow-by gas, there is formed a slit 51 for taking the blow-by gas therefrom into the cone 31. The slit 51 has a predetermined width, and extending to the partition wall 41 side from the position at which the outer peripheral wall 48 of the rectification chamber 20 crosses the outer peripheral wall of the cone 31. The slit 51 has a height covering the height of the partition wall 41 in a height direction thereof. Further, the slit 51 opens toward the flow-in port 22, and a portion of the partition wall 41 constituting a side surface of the slit 51 is formed in parallel to the slit 51.

Therefore, the blow-by gas flowing from the flow-in port 22 into the rectification chamber 20 flows from the slit 51 into the cone 31 along inner surface of the partition wall 41 of the cone 31, thereby forming a clockwise swirl-like flow.

Cone 32 defines a slit 52 capable of accepting blow-by gas therefrom into the cone 32. The slit 52 has a width extending to the partition wall 42 side from a boundary position between the common wall 45 to the cone 31 positioned near to the flow-in port 22 and the partition wall 42 partitioning the cone 32 and the rectification chamber 20. The slit 52 has a height covering the height of the partition wall 42 in a height direction thereof. Further, an outer surface of the partition wall 41 of the cone 31,a side surface of slit 52 on the common wall 45 side, and the inner surface of the common wall 45 of the cone 32 are smoothly continuous with each other.

Therefore, the blow-by gas flowing from the flow-in port 22 into the rectification chamber 20 along the partition wall 41 flows from the slit 52 into the cone 32 along the inner surface of the cone 32 of the common wall 45, thereby forming a counterclockwise swirling flow.

Cone 33 and 34 defines slit 53 and a slit 54, respectively, in the same respect as that of the slit 52 in the cone 32. Further, the blow-by gas flowing into the cone 33 and the cone 34 forms a counterclockwise swirl-like flow as in the case of the cone 32.

Figure 3:
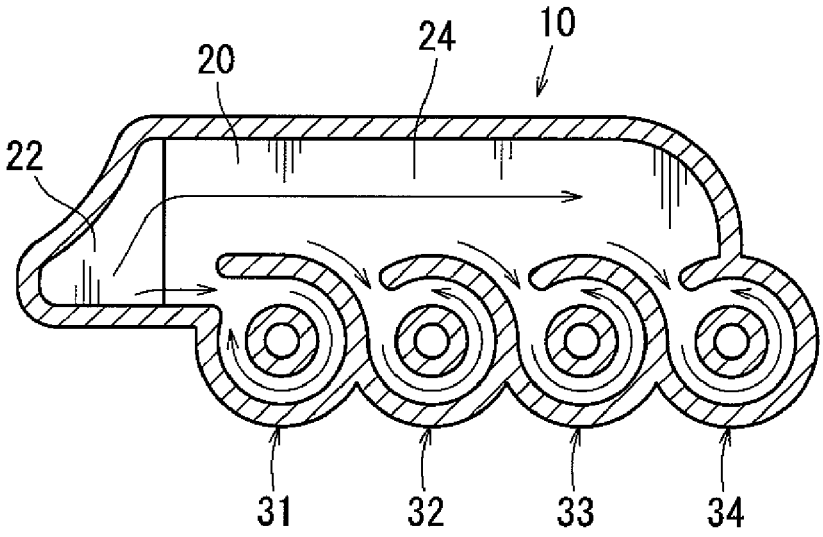
FIG. 3 is a diagram illustrating a flow of blow-by gas in an upper portion of the oil separator.

FIG. 3 illustrates a horizontal flow of the blow-by gas taken along the line II-II of FIG. 1.

As described above, the slits 51 through 54 are formed in parallel to an axial direction of the cones 31 through 34, and the blow-by gas is directed into the cones through each respective slit.

Note that, in this embodiment the slits 51 through 54 are spaced approximately equal from each other.

As described above, when the blow-by gas flows into the oil separator 10, the blow-by gas flows inside the cones through the slits 51 through 54 from a tangential direction of the outer walls of the cones along the inner surfaces of the cones, thereby forming a swirl-like flow. As a result, in the oil separator 10, the oil mist contained in the blow-by gas can be efficiently agglutinated, and hence the oil mist can be efficiently trapped.

In the rectification chamber 20, a gas flow channel 24 is provided for supplying the blow-by gas to the cones 31 through 34. The width of the gas flow channel 24 is ensured so as not to disturb the flow of the blow-by gas. Therefore, the blow-by gas flowing from the flow-in port 22 into the rectification chamber 20 can flow uniformly to both a side nearer the flow-in port 22 and a deep side of the rectification chamber 20.

Accordingly, the blow-by gas is uniformly distributed to the cones 31 through 34, and hence each cone can exert the same processing efficiency. As a result, without excessively supplying the blow-by gas to a specific cone, each cone can efficiently trap the oil mist until a flow rate of the blow-by gas reaches a limit flow rate of the oil separator 10 in view of it's the efficient processing performance.

Figure 4:
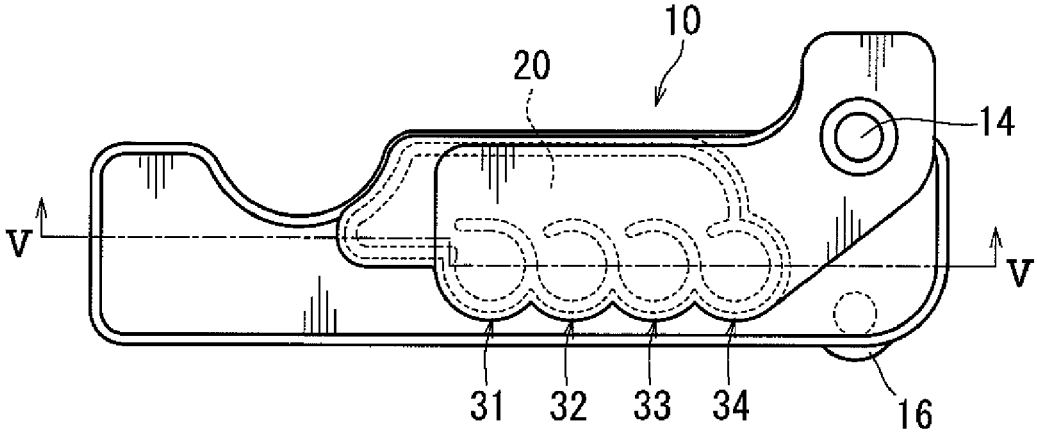
FIG. 4 is an external plane view of the oil separator according to the embodiment of the present invention.
Figure 5:
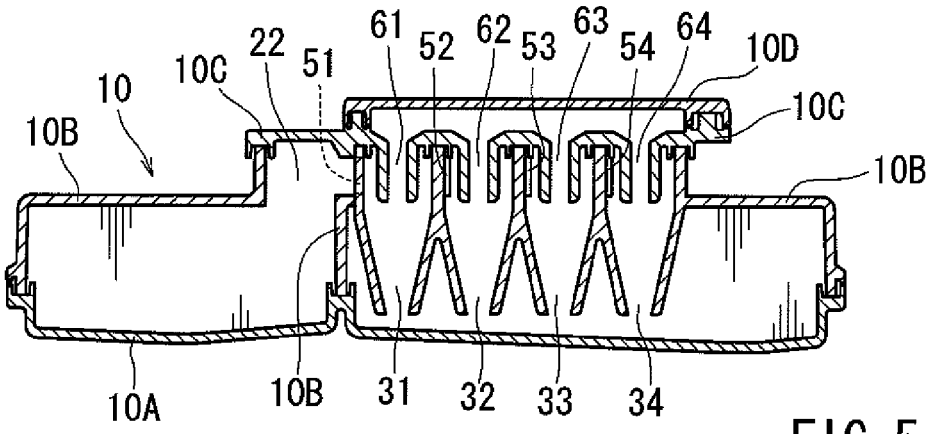
FIG. 5 is a sectional view taken along the line V-V of FIG. 4.

FIG. 4 is an external plane view of the oil separator 10 according to this embodiment. FIG. 5 is a sectional view taken along the line V-V of FIG. 4.

The oil mist contained in the blow-by gas flowing from the slits 51 through 54 to the cones 31 through 34 is condensed to become oil droplets because of a centrifugal force via the swirl-like flow generated inside the cones 31 through 34. Then, the oil mist, which has become the oil droplets, streams down the inner side of the outer peripheral walls of the cones 31 through 34, or dropped to bottom portion of the cones 31 through 34, thereby directed to the oil drain 16 from the bottoms of the cones 31 through 34, and to be collected from the oil drain 16.

Further, the blow-by gas from which the oil mist is separated flows out from flow-out ports 61 through 64 of the cones 31 through 34, thereby being directed from the gas exhaust port 14 to the outside of the oil separator 10.

Figure 6:
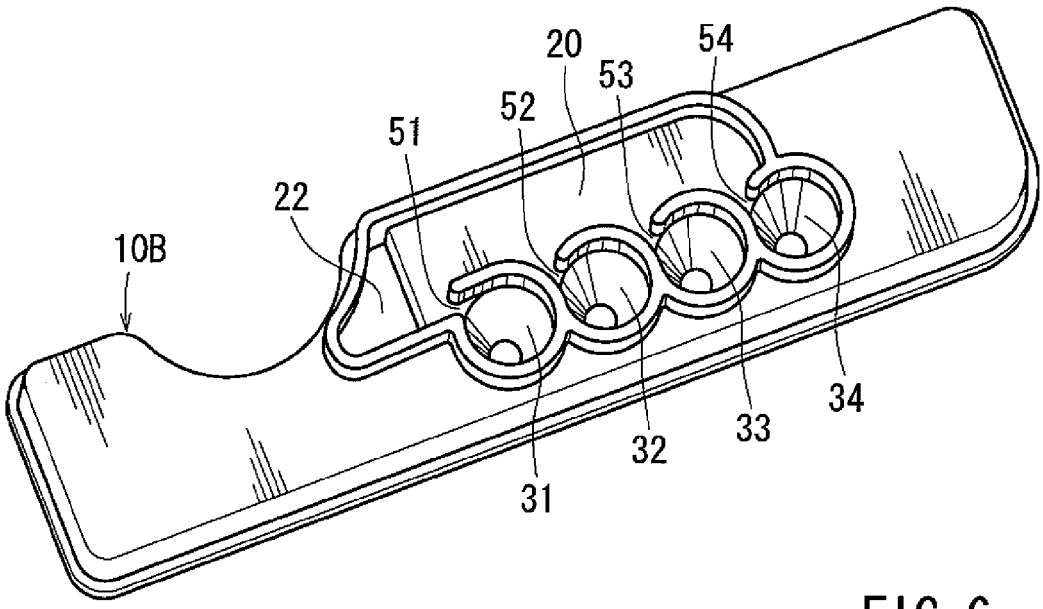
FIG. 6 is an external perspective view of a cone portion constituting the oil separator.

As illustrated in FIG. 5, the oil separator 10 includes four components including a lower case 10A, a cone portion 10B, a gas exhaust portion 10C, and an upper case 10D. FIG. 6 is an external perspective view of the cone portion 10B. The oil separator 10 has a simple structure, and hence the manufacturing cost therefor can be kept low.

While in this embodiment the oil separator is structured so as to be arranged inside the head cover of the automobile engine, the oil separator may be arranged in a place other than the inside of the head cover.

In addition, four cones are arranged in parallel in this embodiment, but the number of cones arranged in parallel is not limited to four. Further, the configuration of the rectification chamber is not limited to that in this embodiment, and various configurations can be adopted without departing from the spirit of the present invention.

The present invention is not limited to an oil separator attached to the automobile engine, and is also applicable as a separator for separating oil in the blow-by gas generated inside the internal combustion engine other than the automobile engine.

What is claimed is:

1. An oil separator for trapping oil mist contained in blow-by gas generated inside a crankcase of an engine, comprising:

multiple cones arranged in a line; and a rectification chamber containing the cones for the blow-by gas, the rectification chamber extending in parallel to the line of cones and arranged on an upper side of the cones, said rectification chamber including a flow-in port for the blow-by gas, the flow-in port positioned at one end of the line of cones to force blow-by gas in a direction from said one end of the line of cones and into each of the cones, wherein:

each cone includes an upper outer peripheral wall that includes a partition wall and a common wall, said partition wall faces said rectification chamber and partitions the rectification chamber from the cone, and the common wall comprises a wall that is common to an adjacent cone;

the partition wall of each cone defines a slit allowing the blow-by gas to flow into the cone, said slit extending in a direction that is parallel to an axial direction of each such cone; and wherein blow-by gas from the flow-in port enters the rectification chamber, flows inside the rectification chamber along an outer peripheral wall of the rectification chamber or along the partition walls of the cones, and flows through each slit into each cone;

wherein a first cone is positioned nearer to the flow-in port than all other cones, the slit of the first cone includes a height approximately the same as a height of the first cone's partition wall, the slit of the first cone opens toward the flow-in port, and a portion of the partition wall that comprises a side surface of the slit is formed in parallel to an opening direction of the slit; and the slit of each cone other than the first cone extends between each such cone's partition wall and the common wall of each such cone and a cone positioned nearer to the flow-in port, wherein the slit of each such other cone includes a height approximately the same as a height of the each such cone's partition wall; and wherein said partition walls and said common walls are continuous with each other.

2. An oil separator according to claim 1, wherein the rectification chamber defines a gas flow channel having a width that ensures an even distribution of the blow-by gas among the cones.

3. An oil separator according to claim 1, wherein the oil separator is arranged inside a cylinder head cover of an automobile engine.

4. An oil separator inside an engine, comprising:

a plurality of cones arranged in a line; and a chamber containing the cones configured to receive blow-by gas and positioned adjacent the line of the cones, the chamber including a flow-in port positioned at one end of the line of cones, wherein:

each cone includes an upper outer peripheral wall forming a partition wall, the partition wall faces a wall of the chamber and is positioned to divide the chamber and each such cone, and each of the upper outer peripheral walls also comprises a common wall shared with the upper outer peripheral wall of an adjacent cone;

further wherein each upper outer peripheral wall defines a slit to receive blow-by gas into each cone in a tangential direction;

wherein for each cone other than the cone nearest to the flow-in port, the slit extends between the common wall of an adjacent cone positioned nearer to the flow-in port and the partition wall of the cone, wherein the slit includes a height that is the same as a height of the partition wall of said cone, and wherein an outer surface of the partition wall of the cone nearer to the flow-in port, a side surface of the slit on the side of the common wall, and an inner surface of the common wall of the cone are continuous with each other.

5. An oil separator according to claim 4, wherein:

a first cone in the plurality of cones is positioned nearer to the flow-in port than all other cones, the slit of the first cone extends in a direction so that the blow-by gas enters the first cone in a first direction.

6. An oil separator according to claim 5, wherein the blow-by gas forms a clockwise swirl-like flow in the first cone.

7. An oil separator according to claim 5, wherein the slit of the first cone includes a height substantially equal to a height of the partition wall of the first cone and is opened toward the flow-in port.

8. An oil separator according to claim 7, wherein a side surface of the slit of the partition wall of the first cone is formed in parallel to an opening direction of the slit.

9. An oil separator according to claim 4, wherein the chamber has a width that ensures that the blow-by gas is distributed uniformly to the plurality of cones.

10. An oil separator according to claim 4, wherein a surface of the flow-in port is recessed from a surface of the chamber.

11. An oil separator for use in an engine, the oil separator comprising:

a plurality of cones arranged in a line; and a chamber containing the cones configured to receive blow-by gas and having a wall positioned adjacent the line of the cones, the chamber including a flow-in port positioned at one end of the line of cones, wherein:

each cone includes an upper outer peripheral wall forming a partition wall, the partition wall faces the chamber wall and is positioned to divide the chamber and each such cone, and each of the upper outer peripheral walls also comprises a common wall shared with the upper outer peripheral wall of an adjacent cone;

further wherein each upper outer peripheral wall defines a slit to receive blow-by gas into each cone in a tangential direction;

a first cone in the plurality of cones is positioned nearer to the flow-in port than all other cones, the slit of the first cone extends in a direction so that the blow-by gas enters the first cone in a first direction; and wherein the slits of cones other than the first cone extend in a different direction so that the blow-by gas enters the cones other than the first cone in a second direction.

12. An oil separator according to claim 11, wherein the blow-by gas forms a counter-clockwise swirl-like flow in the cones other than the first cone.

13. An oil separator according to claim 11, wherein the slit of the first cone includes a height substantially equal to a height of the partition wall of the first cone and is opened toward the flow-in port.

14. An oil separator according to claim 13, wherein a side surface of the slit of the partition wall of the first cone is formed in parallel to an opening direction of the slit.

15. An oil separator according to claim 11, wherein a surface of the flow-in port is recessed from a surface of the chamber.

16. An oil separator for an engine, comprising:

a plurality of cones positioned along a line; and a chamber containing the cones configured to receive blow-by gas and having a wall positioned adjacent the line of the cones, the chamber including a flow-in port positioned at one end of the line of cones;

wherein each cone includes an upper outer peripheral wall forming a partition wall that faces the chamber wall and divides the chamber and each such cone, and each upper outer peripheral wall also forms a wall that is shared with a wall of an adjacent cone;

wherein each upper outer peripheral wall defines a slit for each cone to act as an inlet to permit the blow-by gas to enter each such cone in a tangential direction;

wherein a first cone in the plurality of cones is positioned nearer to the flow-in port than other cones, the slit of the first cone is positioned so that the blow-by gas enters the first cone in a first direction; and wherein the slit of at least one other cone is positioned so that the blow-by gas enters said at least one other cone in a different direction.

17. The oil separator of claim 16 wherein the slits of all cones other than the first cone are positioned so that the blow-by gas enters said all cones besides the first cone in direction that is different than the first direction.

18. The oil separator of claim 16 wherein the blow-by gas is caused to swirl in a clockwise direction in the first cone and in a counterclockwise direction in all other cones.

* * * * *